US005757117A

United States Patent [19]

Hirasawa et al.

[11] Patent Number: 5,757,117

[45] Date of Patent: May 26, 1998

[54] CATHODE RAY TUBE WITH CONDUCTIVE SILICON ADHESIVE

[75] Inventors: Shigemi Hirasawa, Chiba; Norikazu Uchiyama, Mobara; Toshio Tojo, Ichinomiya-machi; Toshio Uyama, Mobara; Hisashi Nose, Chiba; Toshikazu Igarashi, Mobara; Zenjiro Kanzaki, Nagara-machi, all of Japan

[73] Assignees: Hitachi, Ltd., Tokyo; Hitachi Device Engineering Co., Ltd., Chiba-ken, both of Japan

[21] Appl. No.: 698,858

[22] Filed: Aug. 16, 1996

[30] Foreign Application Priority Data

Aug. 29, 1995 [JP] Japan ..... 7-220600

[51] Int. Cl.[6] ..... H01J 29/92

[52] U.S. Cl. ..... 313/479; 313/313; 348/818; 315/85

[58] Field of Search ..... 348/818, 819; 313/479, 313; 315/85; 428/356

[56] References Cited

U.S. PATENT DOCUMENTS 5,025,490 6/1991 Tamura ..... 313/479

5,246,771 9/1993 Kawaguchi ..... 428/356

FOREIGN PATENT DOCUMENTS 174945 6/1992 Japan ..... H01J 29/88

*Primary Examiner*—Sandra L. O'Shea
*Assistant Examiner*—Michael Day
*Attorney, Agent, or Firm*—Antonelli, Terry, Stout & Kraus, LLP

[57] ABSTRACT

In a cathode ray tube having an antistatic film 6 stuck to the front surface of a panel section 1 and a conductive tape 7 for grounding the end portion of the antistatic film 6 to the earth, a silicone adhesive 8 containing a conductive filler having an excellent close contact adhesion to silicon dioxide ($SiO_2$) is interposed in at least a part of an close contact adhesion portion where the conductive tape 7 is stuck to the antistatic film 6. Thanks to the interposition of the conductive filler containing silicone adhesive 8, the resistances between the antistatic film 6 and the conductive tape 7 and between the silicone adhesive 8 and the conductive tape 7 can be lowered and sputtering which may be caused by the high voltage induced in the antistatic film 6 is prevented, so that the breakage of the antistatic film 6 can be prevented at the close contact adhesion portion.

13 Claims, 3 Drawing Sheets

CATHODE RAY TUBE WITH CONDUCTIVE SILICON ADHESIVE

BACKGROUND OF THE INVENTION

1. Field of the Invention

The present invention relates to a cathode ray tube and, more particularly, to a cathode ray tube capable of maintaining the electric connection between a conductive transparent film such as an antistatic film and a grounded connection member satisfactorily for a long time when the conductive transparent film is stuck to the front face of the panel section of the cathode ray tube.

2. Description of the Prior Art

Generally speaking, the cathode ray tube is equipped with an evacuated glass enclosure which is composed of a panel section having a fluorescent surface on its inner face, a neck section accommodating an electron gun, and a funnel section jointing the panel section to the neck section. When this cathode ray tube is operated, a high anode voltage is applied to the fluorescent surface which is formed on the inner face of the glass panel section. In the region confronting the fluorescent surface through the glass panel section, namely, in the front surface of the panel section, there is induced electrostatic charge which corresponds to the high voltage applied to the fluorescent surface by the electrostatic induction. As a result, the operator or the like of the cathode ray tube is electrically shocked by the high voltage generated by the induced electrostatic charge when he touches the surface of the panel section.

In order to protect the operator or the like of the cathode ray tube against such electric shock, there has already been developed an electric shock preventing means for causing the electrostatic charge induced on the panel surface, to flow to the earth by sticking the conductive transparent film to the panel surface and by grounding the conductive transparent film to the earth. This technique is disclosed in Japanese Patent Laid-Open No. 82434/1990 or 174945/1992, for example.

In FIGS. 1 and 2, there is shown the construction of an antistatic type cathode ray tube of the prior art. FIG. 1 is a schematic section showing the construction of the entire structure of the cathode ray tube, and FIG. 2 is a partial view showing the state of the front surface of the front of the cathode ray tube.

In FIGS. 1 and 2, reference numeral 41 designates a panel section; numeral 42 a neck section; numeral 43 a funnel section; numeral 44 a outer conductive film; numeral 45 a reinforcing band; numeral 46 an antistatic film; numeral 47 a conductive adhesive tape; and numeral 48 a protective tape.

In the panel section 41, moreover, fluorescent films (although not shown) of R (red), G (green) and B (blue) colors are formed on the inner surface of the front side, and the (not-shown) shadow mask is mounted on the panel section 41. In the neck section 42, there is accommodated an (not-shown) electron gun. The funnel section 43 connecting the panel section 41 to the neck section 42 has a (not-shown) deflection yoke mounted thereon and the outer conductive film 44 formed over its surface. The reinforcing band 45 is bound around the panel section 1, and the conductive transparent film 46 is formed over the front surface of the panel section 41. The conductive adhesive tape 47 is stuck at a plurality of portions so as to electrically connect the conductive transparent film 46 to the reinforcing band 45. The protective tape 48 is stuck to the conductive transparent film 46 so as to reinforce the adhesion of the conductive transparent film 46. An example of the conductive transparent film 46 is an antimony doped tin oxide (or ATO) thin film having a surface resistance of about $10^8$ Ω/□.

Thanks to this construction, even if any electrostatic charge is produced in the operation of the cathode ray tube by static induction on the front surface of the panel section 41, the electrostatic charge is transferred from the antistatic film 46 through the conductive tape 47 to the grounded reinforcing band 45. The reinforcing band 45 is grounded to the earth. Thus, the operator is prevented from being electrically shocked when he touches the front surface of the panel section 41.

In recent years, it has been considered that the conductive transparent film 46 stuck to the front surface of the panel section of the cathode ray tube is utilized not only to prevent the electric shock as in the prior art but also to block the electric field and the magnetic field which are emitted to the outside from the front surface of the panel section of the cathode ray tube.

In order to block these electric and magnetic fields extending to the outside from the front surface of the panel section of the cathode ray tube by using the conductive transparent film 46 stuck to the front surface of the panel section, the surface resistance of about $10^8$ Ω/□ disclosed in Japanese Patent Laid-Open No. 174945/1992 is too high. The surface resistance is required to be about $10^5$ Ω/□ or less.

When the conductive transparent film 46 having the surface resistance of about $10^5$ Ω/□ or less is formed over the front surface of the panel section of the cathode ray tube and is electrically connected to the grounded reinforcing band 45 through the conductive adhesive tape 47, the conductive adhesive of the conductive adhesive tape 47 of the prior art has a higher surface resistance than that of the conductive transparent film 46 but is insufficient in conductivity, close contact adhesion and heat conductivity. As a result, sputtering between the conductive transparent film 46 and the conductive adhesive tape 47 occurs during the operation of the color cathode ray tube.

In FIGS. 1 and 2, charge is stored all over the conductive transparent film 46. If this conductive transparent film 46 is grounded to the earth through the conductive tape 47, as shown, the discharge may take place all over the conductive tape 47 to cause sputtering. This sputtering may causes a problem that the conductive transparent film 46 is damaged, making it difficult to ground the charge electrostatically induced in the panel surface to the earth.

If the conductive transparent film formed over the front surface of the front section is electrically connected to a separate conductive terminal and if this conductive terminal is grounded to the earth, the partial breakage of the conductive transparent film due to the sputtering may be avoided. If this conductive terminal is provided, there arises a problem that the production cost for the color cathode ray tube is considerably raised.

Incidentally, Japanese Patent Laid-Open No. 82434/1990 has disclosed the cathode ray tube which uses the conductive paste having a resistance of $10^6$ Ω or less. The same publication has also disclosed the concept that the conductive paste is prepared by dispersing graphite particles in a silicone resin. In Japanese Patent Laid-Open No. 82434/1990, however, the paste is disclosed merely as a kind of binder, but no consideration is taken into the conditions of the viscosity of the slurry and the thickness so as to retain the close contact close contact adhesion of the silicone resin to the $SiO_2$ film or the heat radiation.

SUMMARY OF THE INVENTION

The present invention has been made to solve the problem that the conductive transparent film is partially broken by the sputtering which occurs between the conductive transparent film and the conductive adhesive tape. An object of the present invention is to provide a cathode ray tube such that any partial breakage of the antistatic film does not occur and an increase in the production cost is avoided by improving the close contact adhesion and the heat radiation.

In order to achieve the above-specified object, according to the present invention, a cathode ray tube having an antistatic film formed over the front surface of its panel section and grounded at its end portion to the earth through a conductive tape. The cathode ray tube comprises means in which a silicone adhesive containing a conductive filler having an excellent close contact adhesion to silicon dioxide ($SiO_2$) and a viscosity ranging from 10 P (poise) to $10^6$ P is interposed in at least a part of the close contact adhesion portion where the conductive tape is stuck to the antistatic film.

DESCRIPTION OF THE PREFERRED EMBODIMENTS

Figure 1:
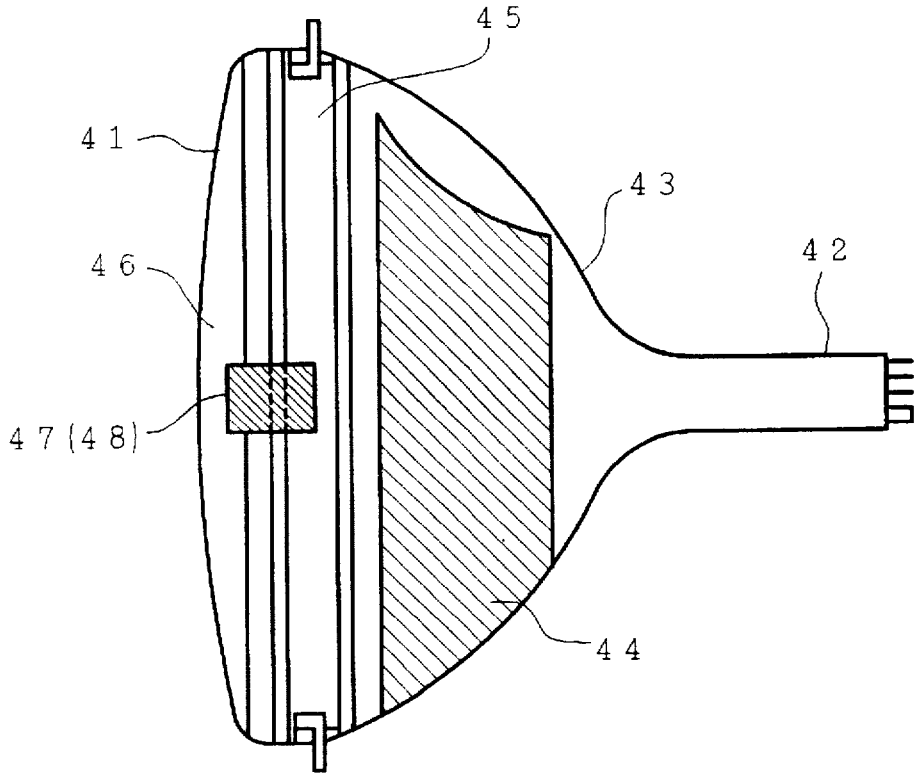
FIG. 1 (Prior Art)
FIG. 1 is a side elevation showing the construction of an essential part of an antistatic type cathode ray tube of the prior art.
Figure 2:
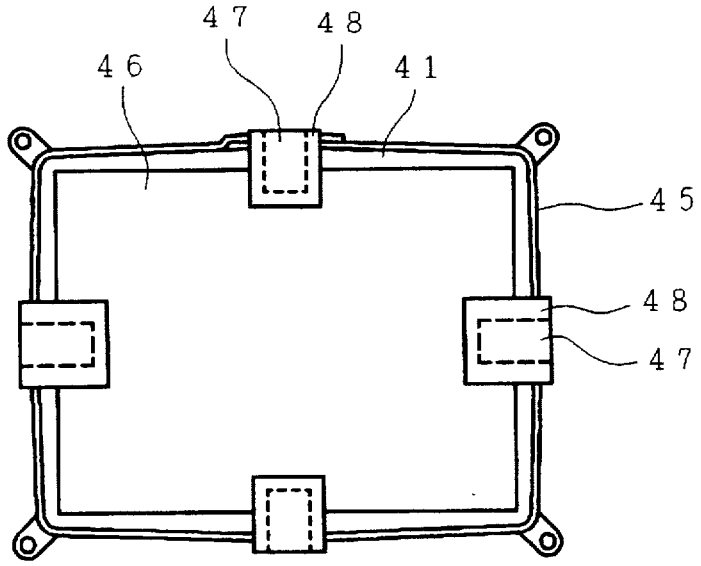
FIG. 2 (Prior Art)
FIG. 2 is a partial construction diagram showing a state of the front face of the panel section of the antistatic type cathode ray tube of the prior art.

An antistatic film formed over a panel surface is composed of a conductive transparent film and a silicon dioxide ($SiO_2$) film, and its outermost surface portion has a silicon dioxide ($SiO_2$) structure. Our investigation has led to the fact that the adhesive having the best wettability (adhesion) for the silicon dioxide ($SiO_2$) structure is a silicone adhesive.

The present invention has been made on the basis of such a finding, and includes a means in which to stick a conductive tape 7 to an antistatic film 6, a silicone adhesive 8 which contains a conductive filler having a satisfactory wettability (adhesion) to the silicon dioxide ($SiO_2$) structure of the outermost surface of the antistatic film 6 is interposed in at least a part of the close contact adhesion portion of the antistatic film 6 and the conductive tape 7.

On the other hand, the antistatic film 6 is damaged by the sputtering action at the time of discharge between the antistatic film 6 and the conductive tape 7. This sputtering is strongly influenced by the temperature, and more liable to occur for higher temperature.

The thermal conductivity is $1.6\times10^{-7}$ to $2.9\times10^{-7}$ cal/cm.sec.°C. for glass and $2\times10^{-4}$ to $45\times10^{-4}$ cal/cm.sec.°C. for silicone resin. Specifically, silicone resin has a higher thermal conductivity and accordingly a higher heat radiation than glass so that it can prevent the sputtering.

By determining the thickness of the silicone adhesive 8 containing the conductive filler and interposed between the antistatic film 6 and the conductive tape to be 100 μm (1/10 mm) or more, an excellent close contact adhesion can be given to the $SiO_2$ structure of the outermost surface of the antistatic film 6 while preventing the sputtering.

So-called "slurry" containing fine particles in a fluid (or liquid) has a thixotropy and hence it exhibits a behavior similar to a substance of high viscosity in a state that no stress (no load) is applied thereto, and a behavior similar to a substance of low viscosity in a state that stress (load) is applied. The slurry having such a thixotropy may exhibit a viscosity of about 100 P in a no-load state and a kinematic viscosity substantially as high as 500 P in a loaded state. When a silicone adhesive 8 containing a conductive filler is interposed between the antistatic film 6 and the conductive tape 7, a thickness of 100 μm or more can be easily achieved in practice if the kinematic viscosity is about 500 P in the loaded state.

Silicone resin is usually contained in a plastic container (or tube) or a dedicated cartridge and may be so viscous that it can be pressed out easily from a nozzle (having a diameter of 1 to 5 mm). In this case, the silicone resin can have a viscosity as high as several $10^4$ P.

Moreover, silicone resin can be canned if much used, and the viscosity can be several $10^5$ P if a knife is used for the application.

Considering these causes the viscosity of the silicone adhesive 8 containing a conductive filler can has a practical range of 10 P to $10^6$ P.

Even when not only a conductive transparent film 61 having a surface resistance of about $10^8$ Ω/□ but also a conductive transparent film 61 having a surface resistance of about $10^5$ Ω/□ or less is formed over the front face of the panel section of the cathode ray tube, the resistance between the conductive transparent film 61 and the silicone adhesive (or conductive tape) containing the conductive filler is considerably lower than that of conventional adhesives. As a result, no sputtering occurs between the antistatic film, in which a high voltage is induced, and the conductive tape, so that the breakage of the antistatic film 6 can be prevented in advance.

In addition, the adhesion of the antistatic film to the conductive tape is improved to increase the heat trasfer of the close contact adhesion portion. On the other hand, silicone adhesive itself containing conductive filler is not expensive, so that the production cost for the color cathode ray tube is not raised even when the silicone adhesive containing conductive filler.

First Embodiment

Embodiments of the present invention will be described in detail with reference to the accompanying drawings.

Figure 3:
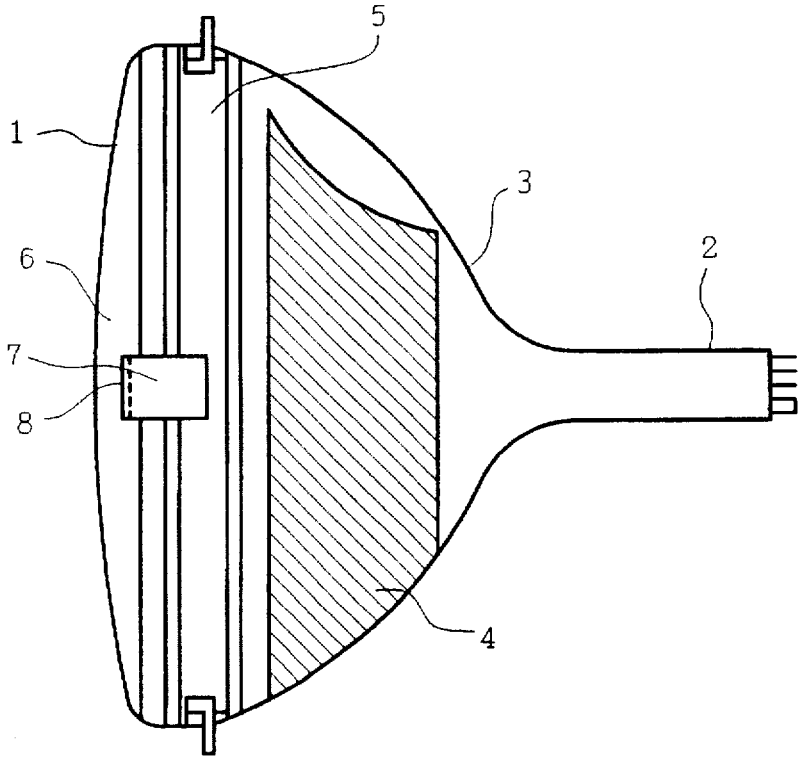
FIG. 3 is a side elevation showing the construction of an essential part of a color cathode ray of one embodiment according to the present invention.
Figure 4:
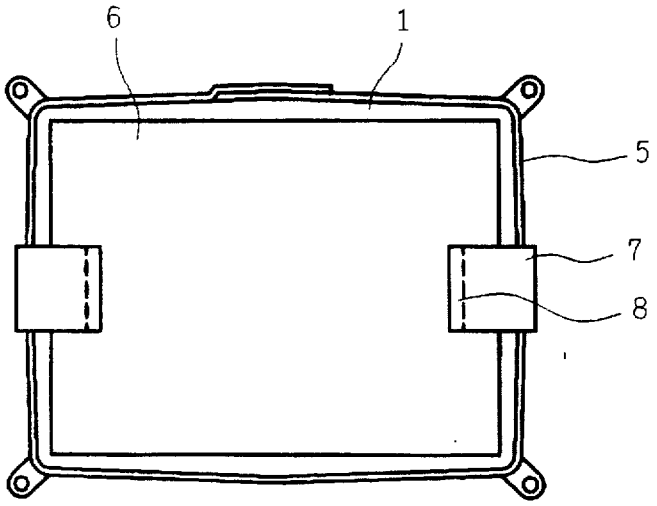
FIG. 4 is a partial construction diagram showing a state of the front face of the panel section of an essential part of the color cathode ray tube of the embodiment according to the present invention.

FIGS. 3 and 4 are diagrams showing the construction of an essential part of a color cathode ray tube of one embodiment according to the present invention. FIG. 3 is a side elevation showing the construction of the entire structure schematically, and FIG. 4 is a front view showing the state of the front face of the panel section of the cathode ray tube.

In FIGS. 3 and 4: reference numeral 1 designates a panel section; numeral 2 a neck section; numeral 3 a funnel section; numeral 4 a outer conductive film; numeral 5 a reinforcing band; numeral 6 an antistatic film; numeral 7 a conductive tape; and numeral 8 a silicone adhesive containing a conductive filler having an excellent close contact adhesion to the silicon oxide ($SiO_2$). This silicone adhesive may be SE5085EC Silicone RTV (trade name) containing graphite as the conductive filler.

In the panel section 1, moreover, a (not-shown) fluorescent film is formed over the inner surface of the front, and a (not-shown) shadow mask is mounted therein. The neck section 2 has a (not-shown) electron gun mounted therein. The funnel section 3 coupling the panel section 1 to the neck section 2 has a (not-shown) deflection yoke mounted thereon and the outer conductive film 4 formed over its surface. The reinforcing band 5 is bound around the panel section 1, and the antistatic film 6 is formed over the surface of the front of the panel section 1. The conductive tape 7 is stuck at a plurality of (two in the embodiment shown in FIG. 4) portions so as to electrically connect the antistatic film 6 and the reinforcing band 5. The silicone adhesive 8 containing the conductive filler is interposed in at least the close contact adhesion portion between the antistatic film 6 and the conductive tape 7.

Figure 5:
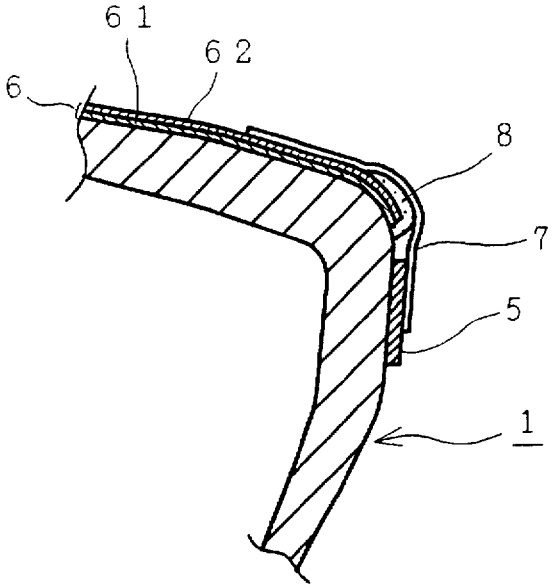
FIG. 5 is an enlarged section showing the construction of a part of a first example of the embodiment shown in FIG. 3, in which a silicone adhesive containing a conductive filler is interposed.

Next, FIG. 5 is an enlarged section showing the construction of a part of the first embodiment in which the silicone adhesive 8 containing the conductive filler is interposed.

In FIG. 5, the same components as those appearing in FIGS. 3 and 4 are designated by the identical reference numerals. The antistatic film 6 is composed of a conductive transparent film 61 and a kind of film 62 of $SiO_2$. This film (hereinafter referred to as the "$SiO_2$ film") 62 is used to prevent reflection or to protect the conductive transparent film 61 because this film 61 is liable to peel off.

In the first embodiment of FIG. 5, there is shown a cathode ray tube in which the conductive tape 7 electrically connects the conductive transparent film 6 to the reinforcing band 5. To the vicinity of the edge of the antistatic film 6, corresponding to the vicinity of the central portion of the conductive tape 7, there is applied the silicone adhesive 8 which contains the conductive filler. At this case, the conductive filler containing silicone adhesive 8 has a thickness of 100 μm or more, a specific resistance of 100 Ωcm or less and a viscosity ranging from 10 P to $10^6$ P. With this silicone adhesive 8, an excellent close contact adhesion of the $SiO_2$ structure of the outermost surface portion of the antistatic film 6 is achieved, and sputtering can be prevented because the resistance between the antistatic film 6 and the conductive film 7 stacked by the conductive filler containing silicone adhesive 8 drops.

Thanks to this construction, even if electrostatic charge is produced in the operation of the cathode ray tube by static induction in the conductive transparent film 61 formed over the front surface of the panel section 1, the electrostatic charge is transferred from the close contact adhesion portion between the antistatic film 6 and the conductive filler containing silicone adhesive 8 to the conductive tape 7 and further from the conductive film 7 to the grounded reinforcing band 5, so that the operator is not electrically shocked even if he touches the front surface of the panel section 1.

The conductive transparent film 61 need not be in direct contact with the conductive filler containing silicone adhesive 8. This is because a capacitor is formed by the conductive transparent film 61, the $SiO_2$ film 62 and the silicone adhesive 8.

Since the charge is stored all over the area of the conductive transparent film 61, as shown in FIG. 5, discharge is caused at the leading end of the conductive tape 7 when the grounding is taken by the conductive tape 7, as shown, and the conductive transparent film 61 may be partially damaged. Even if, however, sputtering is started, the resistance of the sputtering portion gradually increases, but the silicone adhesive 8 is still held at a low resistance, so that the electrical connection of the entirety is not broken.

Since, moreover, the conductive filler containing silicone adhesive 8 used has a specific resistance no more than 100 Ωcm and a viscosity of 10 P to $10^6$ P, its thickness can be easily set to 1/10 mm or more. Still moreover, the silicone resin has a heat conductivity of (2 to 45)×$10^{-4}$ cal/cm.sec.°C., so that it can exhibit its excellent thermal conductivity to prevent the disappearance of the conductive transparent film 61.

Second Embodiment

Figure 6:
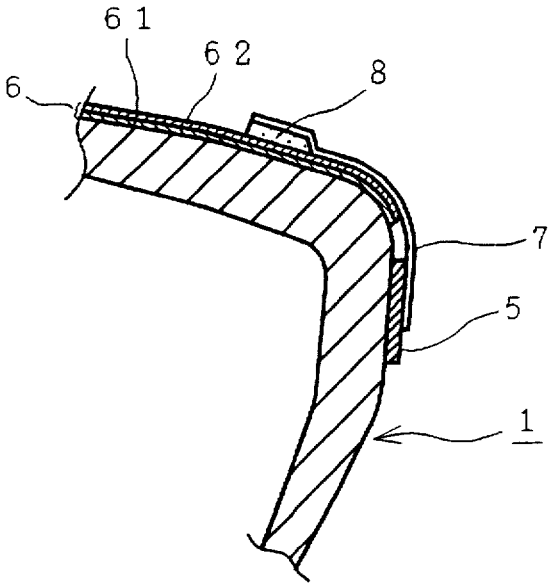
FIG. 6 is an enlarged section showing the construction of a part of a second example of the embodiment shown in FIG. 3, in which a silicone adhesive containing a conductive filler is interposed.

FIG. 6 is an enlarged section showing the construction of a part of a second embodiment in which the conductive filler containing silicone adhesive 8 is interposed.

In FIG. 6, the same components as those appearing in FIG. 5 are designated by the identical reference numerals. The antistatic film 6 is formed of the conductive transparent film 61 and the film 62 of $SiO_2$. This $SiO_2$ film 62 is used to prevent reflection or to protect the conductive transparent film 61 because this film 61 is liable to peel off.

In the second embodiment shown in FIG. 6, the silicone adhesive 8 containing the conductive filler is applied to the antistatic film 6 in the vicinity of one end of the conductive tape 7, when this conductive tape 7 is stuck to the antistatic film 6 and the reinforcing band 5. At this time, the conductive filler containing silicone adhesive 8 has a thickness of 100 μm or more, a specific resistance of 100 Ωcm or less and a viscosity ranging from 10 P to $10^6$ P. With this silicone adhesive 8, sputtering can be prevented because the resistance between the antistatic film 6 and the conductive film 7, stuck by the conductive filler containing silicone adhesive 8 drops. Moreover, the close contact adhesion between the antistatic film 6 and the conductive tape 7 is improved.

Thanks to this construction, even if electrostatic charge is produced in the operation of the cathode ray tube by static induction in the conductive transparent film 61 formed over the front surface of the panel section 1, the electrostatic charge is transferred through the conductive filler containing silicon adhesive 8 to the conductive can bring about the satisfactory results if it is given the following composition and properties. Moreover, the close contact adhesion between the antistatic film 6 and tape 7 and further from the conductive film 61 to the grounded reinforcing band 5 is improved.

This is because a capacitor is formed by the conductive transparent film 61, the $SiO_2$ film 62 and the conductive filler containing silicone adhesive 8. This silicone adhesive 8 is used at that end portion of the conductive tape 7, at which sputtering is the most liable to occur, so that the conductive transparent film 61 can be sufficiently grounded without any damage.

As a result, the operator is not electrically shocked even he touches the front surface of the panel section 1.

Since, moreover, the conductive filler containing silicone adhesive 8 used has a specific resistance no more than 100 Ωcm and a viscosity of 10 P to $10^6$ P, its thickness can be easily set to 100 μm or more. Still moreover, the silicone resin has a heat conductivity of (2 to 45)×$10^{-4}$ cal/cm.sec.°C. so that it can exhibit its excellent thermal conductivity to prevent the disappearance of the conductive transparent film 61.

Third Embodiment

It has been clarified by our experiments that the conductive filler containing silicone adhesive 8 used in the cathode ray tube of the present invention the conductive tape 7 can be improved.

First of all, as the conductive filler contained, not only graphite but also fine particles of silver (Ag), nickel (Ni) or aluminum (Al).

The specific resistance is set to about 100 Ωcm or less or preferably about 20 Ωcm or less by selecting the silicone adhesive.

The viscosity is set to 5,000 P or less or preferably to a range from 5,000 to 500 P by adjusting the content of the conductive filler.

The conductive filler containing silicone adhesive 8 interposed between the antistatic film 6 and the conductive tape 7 is given a thickness of 100 μm or more.

Thus, in the present embodiment, the conductive tape 7 is stuck through the conductive filler containing silicone adhesive 8 to the antistatic film 6 formed over the front surface of the panel section of the cathode ray tube, so that the resistances between the antistatic film 6 and the conductive tape 7 and between the conductive filler containing silicone adhesive 8 and the conductive tape 7 can be drastically reduced. Moreover, the close contact adhesion between the antistatic film 6 and the conductive tape 7 is improved.

In addition, the heat radiation from the close contact adhesion portion between the antistatic film 6 and the conductive tape 7 can be enhanced. From these reasons, sputtering which may break the antistatic film 6, can be prevented from occurring between the antistatic film 6, the voltage of which is raised by the induced electrostatic charge, and the conductive tape 7 so that the breakage of the antistatic film 6 can be prevented.

Incidentally, in the foregoing embodiments described above, SE5085EC Silicone RTV which contains the graphite serving as the conductive filler is used as the silicone adhesive 8. However, the material of the conductive filler containing silicone adhesive 8 employed in the present invention should not be limited thereto but may be another conductive filler containing silicone adhesive having an excellent close contact adhesion to silicon dioxide ($SiO_2$) as long as it has the above-specified composition and properties.

The conductive transparent film 61 of the antistatic film 6 may be an ATO film, an ITO (Indium Tin Oxide) film or another similar conductive transparent film.

As has been detailed described hereinbefore, according to the present invention, the silicone adhesive containing the conductive filler is interposed between the antistatic film stuck to the front surface of the panel section of the color cathode ray tube and the conductive tape for grounding the antistatic film to the earth. As a result, the resistances between the antistatic film and the conductive tape and between the conductive filler containing silicone adhesive and the conductive tape can be drastically reduced. Moreover, the adhesion between the antistatic film and the conductive tape can be improved to enhance the heat radiation from the close contact adhesion portion between the antistatic film and the conductive tape, so that sputtering which damages the antistatic film can be prevented from occurring between the high voltage due to the static charge induced in the antistatic film and the conductive tape. There arises an effect that the breakage of the antistatic film can be prevented in advance.

According to the present invention, furthermore, only the conductive filler containing silicone adhesive is interposed between the antistatic film and the conductive tape, the silicone adhesive itself is not expensive, and consequently the use of the conductive filler containing silicone adhesive brings about another effect that the production cost of the color cathode ray tube is not raised.

What is claimed is:

1. A cathode ray tube having an antistatic film formed over the front surface of its panel section and grounded to the earth through a conductive tape, comprising: an adhesive portion where said conductive tape is stuck to said antistatic film; and a silicone adhesive containing a conductive filler and interposed in at least a part of said adhesive portion, and having a thickness of no less than 100 μm.

2. A cathode ray tube according to claim 1, wherein said silicone adhesive has a specific resistance of no more than 100 Ωcm.

3. A cathode ray tube according to claim 2, wherein said silicon adhesive has a viscosity ranging from 10 P to $10^6$ P.

4. A cathode ray tube according to claim 2, wherein said silicon adhesive has a viscosity ranging from 500 P to 5,000 P.

5. A cathode ray tube according to claim 1 or 2, wherein said conductive filler is composed of fine particles of a material selected from the group consisting of graphite, silver (Ag), nickel (Ni) and aluminum (Al).

6. A cathode ray tube according to 5, wherein said silicon adhesive is positioned at an end portion of said antistatic film.

7. A cathode ray tube according to 5, wherein said silicone adhesive is positioned at an end portion of said conductive tape.

8. A cathode ray tube according to claim 1, wherein said antistatic film comprises a conductive transparent film and a silicon dioxide film.

9. A cathode ray tube according to claim 8, wherein said silicon dioxide film is provided on an outermost surface of said front surface of the panel section.

10. A cathode ray tube according to claim 9, wherein said conductive transparent film has a surface resistance of about $10^5$ Ω/□ or less.

11. A cathode ray tube according to claim 10, wherein said conductive filler is composed of fine particles of a material selected from the group consisting of graphite, silver (Ag), nickel (Ni) and aluminum (Al).

12. A cathode ray tube according to claim 11, wherein said silicon adhesive is positioned at an end portion of said antistatic film.

13. A cathode ray tube according to claim 11, wherein said silicone adhesive is positioned at an end portion of said conductive tape.

* * * * *